US006268102B1

(12) United States Patent
Hopper et al.

(10) Patent No.: US 6,268,102 B1
(45) Date of Patent: Jul. 31, 2001

(54) TONER COAGULANT PROCESSES

(75) Inventors: Michael A. Hopper, Toronto; Raj D. Patel, Oakville; Tanya J. Martin, Burlington, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/551,465

(22) Filed: Apr. 17, 2000

(51) Int. Cl.[7] ..... G03G 9/08
(52) U.S. Cl. ..... 430/137.14; 523/335
(58) Field of Search ..... 430/137; 523/335

(56) References Cited

U.S. PATENT DOCUMENTS

| | | | | |
|---|---|---|---|---|
| 4,797,339 | | 1/1989 | Maruyama et al. | 430/109 |
| 4,981,765 | | 1/1991 | Mizuguchi | 430/5 |
| 4,983,488 | | 1/1991 | Tan et al. | 430/137 |
| 4,996,127 | | 2/1991 | Hasegawa et al. | 430/109 |
| 5,069,893 | | 12/1991 | Haase et al. | 423/556 |
| 5,149,400 | | 9/1992 | Haase et al. | 162/181.6 |
| 5,248,440 | * | 9/1993 | Mitchell et al. | 210/712 |
| 5,278,020 | | 1/1994 | Grushkin et al. | 430/137 |
| 5,290,654 | | 3/1994 | Sacripante et al. | 430/137 |
| 5,296,213 | | 3/1994 | Haase et al. | 423/326 |
| 5,766,818 | | 6/1998 | Smith et al. | 430/137 |
| 5,804,349 | | 9/1998 | Ong et al. | 430/110 |
| 5,827,633 | | 10/1998 | Ong et al. | 430/137 |
| 5,840,462 | | 11/1998 | Foucher et al. | 430/137 |
| 5,853,944 | | 12/1998 | Foucher et al. | 430/137 |
| 5,869,215 | | 2/1999 | Ong et al. | 430/137 |
| 5,944,650 | | 8/1999 | Hu et al. | 516/57 |
| 5,994,020 | | 11/1999 | Patel et al. | 430/137 |

* cited by examiner

*Primary Examiner*—Christopher Rodee
(74) *Attorney, Agent, or Firm*—E. O. Palazzo

(57) ABSTRACT

A process for the preparation of toner comprising mixing a colorant, a latex, optionally a wax and a polyaluminum sulfosilicate.

42 Claims, No Drawings

TONER COAGULANT PROCESSES

PENDING APPLICATIONS AND PATENTS

In copending application U.S. Ser. No. 922,437, now abandoned the disclosure of which is totally incorporated herein by reference, is illustrated, for example, a process for the preparation of toner comprising (i) aggregating with a metal complex, or metal ion a colorant dispersion with a latex emulsion and optional additives to form aggregates;

(ii) coalescing or fusing the aggregates; and optionally (iii) isolating, washing, and drying the toner.

Illustrated in U.S. Pat. No. 5,944,650, the disclosure of which is totally incorporated herein by reference are cleavable or hydrolyzable surfactants of the Formulas (I), (II), or (III), and in U.S. Pat. No. 5,766,818, the disclosure of which is totally incorporated herein by reference, are toner processes wherein cleavable surfactants are selected, and which surfactants may be selected.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence and wherein one of the coagulants may be polyaluminum chloride.

Also illustrated in U.S. Pat. Nos. 5,994,020 and 6,130,021, the disclosures of each application being totally incorporated herein by reference, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

The appropriate components and processes of the above recited copending applications and patents may be selected for the processes of the present invention in embodiments thereof.

BACKGROUND OF THE INVENTION

The present invention is generally directed to toner processes, and more specifically, to chemical processes which involve the aggregation and fusion of latex, colorant like pigment, or dye, and additive particles into toner particles, and wherein aggregation can be primarily controlled by utilizing a coagulant of polyaluminum sulfosilicate (PASS), which silicate is commercially available, and is believed to be disclosed in U.S. Pat. Nos. 4,981,675; 5,069,893; 5,149,400; 5,296,213, the disclosures of which are totally incorporated herein by reference; optionally an ionic surfactant as a co-coagulant, such as SANIZOL B™, that is a benzylalkonium chloride, and wherein there is preferably selected a latex comprised of, for example, submicron resin particles preferably in the size range of about 0.1 to about 0.4 micron in volume average diameter, suspended in an aqueous phase of water, nonionic and anionic surfactants and optionally suspended in an anionic surfactant to which is added a colorant dispersion comprising, for example, preferably submicron colorant particles in the size range of about 0.08 to about 0.3 micron in volume average diameter, anionic surfactant, or optionally a nonionic surfactant, or mixtures thereof, and wherein the resultant blend is preferably stirred and heated to a temperature below the resin Tg, resulting in aggregates to which optionally is added a second latex, followed by adjusting the pH of the mixture with a base, and heating the mixture to a temperature above the resin Tg to fuse the aggregates.

More specifically, the present invention is generally directed to the aggregation and coalescence or fusion of latex, colorant like pigment, dye, or mixtures thereof, in the presence of polyaluminum sulfosilicate, known initiators, and chain transfer agents, and wherein there are generated toner compositions with, for example, a volume average diameter of from about 1 micron to about 25 microns, and preferably from about 2 microns to about 12 microns, and a narrow particle size distribution of, for example, from about 1.10 to about 1.33, and preferably a size distribution in the range of 1.11 to 1.28, the size and size distribution being measured by a Coulter Counter, without the need to resort to conventional pulverization and classification methods. Furthermore, the present invention in embodiments enables minimum washing, for example about 2 to about 4 washings to provide a suitable toner triboelectrical charge such as greater than about 20 $\mu$C/g at 20 percent RH. The toners generated can be selected for known electrophotographic imaging and printing processes, including digital color processes.

Toner generated by the processes of the present invention wherein the coagulant used is polyaluminum sulfosilicate possess a number of advantages as compared to some known emulsion/aggregation processes, these advantages including, for example, a coalescence time of about 0.5 to about 4 hours at a temperature in the range of about 80 to about 95° C. and preferably in the range of about 82° C. to about 90° C. thereby permitting a process reduction time of about 20 to about 40 percent when compared to the use of the same amounts of polyaluminum chloride (PAC). In the embodiments of the present invention wherein when a co-coagulant, such as SANIZOL B™ is used in conjunction with the polyaluminum sulfosilicate (PASS), the process time may be further reduced by about 30 to about 50 percent when compared to polyaluminum sulfosilicate alone. Furthermore, the advantage of using a second coagulant, such as SANIZOL B™, in combination with PASS over PAC is better retention of colorant. Additionally, with the invention processes in embodiments toner washing can be reduced by about 60 to about 75 percent and the triboelectric charging values of the toner obtained are substantially constant irrespective of the colorant selected. Furthermore, when the toners generated are roll milled and aged over a period of, for example, about 2 to about 3 hours there results stable and negative toner charging with, for example, no wrong sign positively charged toner.

The toners generated with the processes of the present invention are especially useful for imaging processes, especially xerographic processes, which usually require toner transfer efficiency in excess of greater than about 90 percent, such as those with a compact machine design without a cleaner or those that are designed to provide high quality colored images with excellent image resolution, acceptable signal-to-noise ratio, and image uniformity.

PRIOR ART

In xerographic systems, especially color systems, small sized toners of preferably from about 2 to about 8 microns are important to the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During the fusing step, moisture escapes from the paper due to high fusing temperatures of from about 120° C. to about 200° C. In the situation wherein with only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it is preferable to select certain toner particle sizes, such as from about 2 to about 10 microns, and with a high colorant, especially pigment loading such as from about 4 to about 15 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes of the present invention minimize, or avoid these disadvantages.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art includes U.S. Pat. Nos. 3,674,736; 4,137,188 and 5,066,560.

Emulsion/aggregation/coalescence processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, 5,346,797; and also of interest may be U.S. Pat. Nos. 5,348,832; 5,405,728; 5,366,841; 5,496,676; 5,527,658; 5,585,215; 5,650,255; 5,650,256 and 5,501,935, 5,723,253, 5,744,520, 5,763,133, 5,766,818, 5,747,215, 5,827,633, 5,853,944, 5,804,349, 5,840,462, 5,869,215. The appropriate components and processes of the above Xerox Corporation patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling. the achievement of excellent color print quality, and wherein a halide, such as a chloride coagulant, can be avoided.

In another feature of the present invention there is provided a process of preparing toner particles which evidence similar charging behavior despite differential colorant chemistry.

Another feature of the present invention resides in the process of preparing pigmented toner particles with certain coagulants.

Yet another feature of the present invention resides in a process of preparing different toner size particles with two coagulants, and wherein minimum amounts of ionic surfactant may be selected.

Additionally, another feature of the present invention resides in a process of providing a process capable of delivering differing toner morphology particles such as spherical.

Another feature of the present invention relates to a process of preparing toners particles with reduced process time when compared to using polyaluminum chloride alone.

In another feature of the present invention there are provided processes capable of generating acceptable stable toner triboelectrical toner values with minimum toner washings.

In a further feature of the present invention there is provided a process for the preparation of toner compositions, with a volume average diameter of from between about 1 to about 25 microns, and preferably from about 2 to about 12 microns, and a particle size distribution of about 1.10 to about 1.28, and preferably from about 1.15 to about 1.25, each as measured by a Coulter Counter without the need to resort to conventional classifications to narrow the toner particle size distribution.

Moreover, in a further feature of the present invention there is provided a process for the preparation of toner by aggregation and coalescence, or fusion (aggregation/coalescence) of latex, resin, colorant, and additive particles, and wherein there is selected a latex prepared by batch emulsion polymerization process and optionally there is selected a latex prepared by semi-continuous polymerizations.

In another feature of the present invention there is provided a process of preparing a latex comprised of submicron resin particles suspended in an aqueous media containing an ionic surfactant only, and optionally containing a nonionic surfactant, wherein the nonionic surfactant can optionally be hydrolyzable, as illustrated in U.S. Pat. No. 5,766,818, the disclosure of which is totally incorporated herein by reference. Furthermore, the ionic surfactant selected can be a sulfonated sodium salt of benzene, 1,1-oxybis, tetrapropylene, such as DOWFAX™, while the nonionic surfactant selected is an ethoxylated phenol of ANTHROX™, and wherein there is selected a polyaluminum sulfosilicate as a coagulant prior to the aggregation.

In yet another feature the present invention resides in the preparation of pigment toner particles wherein the latex can be prepared by batch polymerization and optionally a semi-batch polymerization process containing submicron resin particles suspended in an aqueous phase of surfactants are aggregated with submicron pigment particle and a dual coagulant comprised of polyaluminum sulfosilicate and an ionic surfactant, such as SANIZOL B™, that is a benzylalkonium chloride.

In yet another feature of the present invention there are provided toner compositions with low fusing temperatures of from about 120° C. to about 185° C., and which toner compositions exhibit excellent blocking characteristics at and above about, or equal to about 45° C.

In another feature of the present invention there are provided toner processes capable of providing toners that generate excellent print quality, and high resolution color prints.

In still a further feature of the present invention there are provided toner compositions which provide high image projection efficiency, such as for example over 75 percent as measured by the Match Scan II spectrophotometer available from Million-Roy.

Aspects of the present invention relate to a process for the preparation of toner comprising mixing a colorant, a latex, optionally a wax and a polyaluminum sulfosilicate; a process for the preparation of toner comprising mixing a colorant, a latex, optionally a wax and a polyaluminum sulfosilicate coagulant, and which coagulant assists in permitting aggregation and coalescence of said colorant, said latex, and when present said wax; a process wherein said colorant is a colorant dispersion comprised of (i) a colorant, water, an ionic surfactant, or a nonionic surfactant, and wherein said latex is an emulsion comprised of a nonionic surfactant and an ionic surfactant, water and resin;

(ii) wherein said colorant dispersion is blended with said latex emulsion, and thereafter adding a wax dispersion comprised of submicron wax particles in the size range of from about 0.1 to about 0.5 micron in diameter by volume, which wax is dispersed in an ionic surfactant of the same charge polarity of said latex ionic surfactant present;

(iii) adding to the resulting blend containing the latex, colorant, and said polyaluminum sulfosilicate coagulant to thereby initiate flocculation or aggregation of the resin latex and colorant particles;

(iv) heating the resulting mixture below about, or about equal to the glass transition temperature (Tg) of the latex resin to form toner sized aggregates;

(v) optionally adding a latex comprised of resin particles suspended in an aqueous phase to the formed toner aggregates;

(vi) adding to the mixture resulting a base to thereby arrive at a pH of from about 5 to about 8 for the resulting toner aggregate mixture;

(vii) heating the resulting aggregate suspension of (vi) above about, or about equal to the Tg of the latex resin;

(viii) optionally retaining the mixture (vii) temperature in the range of from about 70° C. to about 95° C. to assist in permitting the fusion or coalescence of the toner aggregates;

(ix) optionally separating and washing the resulting toner slurry; and (x) optionally isolating the toner; a process wherein (viii), (ix) and (x) are accomplished; a process wherein (v), (viii), (ix) and (x) are accomplished; a process wherein there is selected a second coagulant of a cationic surfactant; a process wherein there is selected a second coagulant of a cationic surfactant; a process wherein the cationic surfactant is a benzalkonium chloride; a process wherein the polyaluminum sulfosilicate is selected in an amount of from about 0.05 to about 0.5 percent by weight of latex resin and colorant, and wherein the latex resin, coagulant, and colorant amount totals about 100 percent; a process wherein the base is selected from the group consisting of sodium hydroxide, potassium hydroxide, and ammonium hydroxide; a process wherein there is added to the formed toner aggregates a second latex comprised of submicron resin particles suspended in an aqueous phase containing an ionic surfactant, and wherein the second latex is selected in an amount of about 10 to about 40 percent by weight of the initial latex to form a shell on the first latex; a process wherein the added latex contains the same resin as the initial latex, or wherein the added latex contains a dissimilar resin than that of the initial latex; a process wherein the aggregation (iv) is accomplished by heating at a temperature below about glass transition temperature of the polymer contained in the latex; a process wherein the coalescence (vii) is accomplished by heating at a temperature of about above the glass transition temperature of the polymer contained in the latex; a process wherein the aggregation temperature is from about 40° C. to about 60° C.; a process wherein the coalescence temperature is from about 75° C. to about 97° C.; a process wherein the nonionic surfactant is a cleavable hydrolyzable surfactant; a process wherein the base is an alkali metal hydroxide; a process wherein the hydroxide is sodium hydroxide; a process wherein the pH of the mixture resulting in (vi) is increased from about 2 to about 2.6 to about 5 to about 8, and wherein the base functions primarily as a stabilizer for the aggregates during the coalescence, and no or minimal particle size or GSD increase results; a process wherein the surfactant is (I)

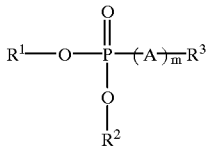

(II)

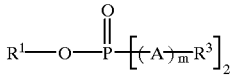

wherein $R^1$ is a hydrophobic aliphatic, or hydrophobic aromatic, such as aryl, group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; a process wherein the temperature at which the aggregation is accomplished controls the size of the aggregates, and wherein the final toner size is from about 2 to about 15 microns in volume average diameter; a process wherein the aggregation (iv) temperature is from about 45° C. to about 55° C., and wherein the coalescence or fusion temperature of (vii) and (viii) is from about 85° C. to about 95° C.; a process wherein the colorant is a pigment, and wherein the pigment is in the form of dispersion, and which dispersion contains an ionic surfactant, and wherein the polyaluminum sulfosilicate functions as a coagulant and enables aggregation of the latex and the colorant; a process wherein the coagulant is added during or prior to aggregation of the latex resin and colorant, and which coagulant enables or initiates the aggregation; a process wherein the latex contains a polymer selected from the group consisting of poly(styrene-alkyl acrylate), poly (styrene-1,3-diene), poly(styrene-alkyl methacrylate), poly (styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly (styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid) and the like; a process wherein the colorant is carbon black, cyan, yellow, magenta, or mixtures thereof; a process wherein the toner isolated is from about 2 to about 15 microns in volume average diameter, and the particle size distribution (GSD) thereof is from about 1.15 to about 1.30; and wherein there is added to the surface of the formed toner additives, such as metal salts, metal salts of fatty acids, silicas, metal oxides, or mixtures thereof, each in an amount of from about 0.1 to about 10 weight percent of the obtained toner; a process which comprises mixing a latex, surfactant and colorant; heating in the presence of a polyaluminum sulfosilicate the resulting mixture below about, or equal to about the glass transition temperature of the resin; followed by the addition of a base to stabilize the toner aggregates; thereafter heating the resulting aggregates above about, or about equal to the glass transition temperature of the resin; and isolating, washing and drying the toner; a process wherein prior to isolating the heating is retained at a temperature of from about 70° C. to about 95° C. until fusion or coalescence of the aggregates is accomplished; a process wherein the hydrolyzable surfactant is a cleavable surfactant selected from the group consisting of poly(ethylene glycol) methyl p-tert-octylphenyl phosphate, poly(ethylene glycol)-α-methyl ether-ω-methyl p-tert-octylphenyl phosphate, poly (ethylene glycol) methyl decylphenyl phosphate, poly (ethylene glycol)-α-methyl ether-ω-methyl dodecylphenyl phosphate, poly(ethyleneglycol) methyl dodecylphenyl phosphate, bis[poly(ethylene glycol)-α-methyl ether]-ω-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly (ethylene glycol) phenyl p-tert-octylphenyl phosphate, poly (ethylene glyco)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly (ethylene oxide-co-propylene oxide) methyl p-tert-octylphenyl phosphate, wherein the polymer chain contains from about 5 to about 50 repeating units or segments; a process wherein there is further added a second coagulant of an alkonium benzalkonium chloride, dialkylbenzenealkyl ammonium chloride, alkylbenzyl methyl ammonium chloride or alkylbenzyl dimethyl ammonium bromide and the like in an amount of from about 0.05 to about 0.5 weight percent by weight; a process for the preparation of toner comprising aggregating and coalescing a colorant dispersion, a latex containing a polymer, a wax, and a polyaluminum sulfosilicate; a process wherein the polyaluminum sulfosilicate is selected in an amount of from about 0.05 to about 0.5 weight percent based on the weight of resin, colorant, wax, and the sulfosilicate; a process wherein the polyaluminum sulfosilicate is selected in an amount of from about 0.05 to about 0.35 weight percent based on the weight of toner solids of resin, colorant, and sulfosilicate; a process wherein the polyaluminum sulfosilicate possesses a weight average molecular weight of from about 5,000 to about 100,000; a process wherein (v) is accomplished; a process for the preparation of toner comprising the mixing of a colorant dispersion, a latex emulsion, a wax dispersion and a polyaluminum sulfosilicate, and wherein the mixture is aggregated by heating below the latex resin glass transition temperature, and fusing the resulting aggregate by heating above the latex resin glass transition temperature, wherein the aggregate mixture is at a pH of from about 5 to about 8, and wherein the latex is comprised of resin, nonionic surfactant, ionic surfactant, and water; a process wherein the sulfosilicate functions as a coagulant and enables or assists in enablement of the aggregation; a process wherein the polyaluminum sulfosilicate is of the formula $$Al_A(OH)_B(SO_4)_C(SiO_x)_D(H_2O)_E$$

where A, B, C, D and E represent the number of segments, and X represents the number of oxygens; a process wherein the polyaluminum sulfosilicate is of the formula $$Al_A(OH)_B(SO_4)_C(SiO_x)_D(H_2O)_E$$

where A, B, C, D and E represent the number of segments, and X represents the number of oxygens; a process wherein A is 1, B is from about 0.75 to about 2, C is from about 0.30 to about 1.12, D is from about 0.005 to about 0.1, and X is from about 2 to about 4; a process for the preparation of toner comprising mixing a colorant, a latex, and a coagulant and optionally two coagulants, followed by aggregation and coalescence; a process wherein the colorant is a colorant dispersion comprised of (i) of a colorant, water, an ionic surfactant, a nonionic surfactant or a mixtures of an ionic surfactant and a nonionic surfactant in the amount range of 60:40 to 40:60 of each; the latex is a latex emulsion comprised of resin, water, nonionic and ionic surfactant; and wherein the (ii) colorant dispersion is blended with the latex emulsion followed by adding a wax dispersion preferably comprised of submicron particles in the size range of about 0.1 to about 0.4 micron dispersed in an anionic surfactant of the same charge polarity to that of the ionic surfactant in the latex emulsion;

(iii) adding to the resulting blend containing the latex and colorant a coagulant of polyaluminum sulfosilicate (PASS) or a mixture of this coagulant together with a cationic surfactant of opposite charge polarity to that of the surfactant latex to thereby initiate flocculation of the resin latex and colorant particles;

(iv) heating the resulting mixture below or about equal to the glass transition temperature (Tg) of the latex resin to form toner sized aggregates;

(v) adding a latex comprised of submicron resin particles suspended in an aqueous phase to the formed toner aggregates resulting in a shell formation wherein the shell is, for example, of from about 0.1 to about 5 microns in thickness;

(vi) adjusting with a base the pH of the resulting toner aggregate mixture to about 5 to about 9 to primarily stabilize the aggregate particles;

(vii) heating the resulting aggregate suspension of (vi) above the Tg of the latex resin;

(viii) retaining the mixture (vii) temperature in the range of from about 700° C. to about 95° C. to initiate the fusion or coalescence of the toner aggregates, (ix) changing the pH of the above (viii) mixture with an acid to arrive at a pH in the range of about 2.8 to about 6 and preferably in the range of about 3 to about 4.5 to accelerate the fusion or the coalescence resulting in toner particle comprised of resin, colorant, and wax, wherein the particle size is about 2 about 25 microns;

(x) optionally washing the resulting toner slurry; and (xi) isolating the toner, followed by drying the toner particles;

a process wherein the two coagulants are comprised of a first coagulant of polyaluminum sulfosilicate and a second coagulant of a cationic surfactant; a process wherein the cationic surfactant is a benzalkonium chloride; a process wherein the polyaluminum sulfosilicate is selected in an amount of from about 0.05 to about 0.5 percent by weight of latex resin and colorant, and wherein the latex resin and colorant amount totals about 100 percent, and the cationic surfactant is selected in an amount of from about 0.05 to 0.6 percent by weight of latex resin and colorant, and wherein the latex resin and colorant amount totals about 100 percent; a process wherein the base is, for example, an alkali metal hydroxide selected, for example, from the group consisting of sodium hydroxide, potassium hydroxide, and ammonium hydroxide; a process wherein there is added to the formed toner aggregates a second latex in the amount of about 10 to about 40 percent by weight of the initial latex and preferably in an amount of about 15 to about 30 weight percent to form a shell on the first latex; a process wherein the added latex comprises the same resin composition and molecular properties as the initial latex used in the blending step or a different composition and properties than that of the initial latex; a process wherein the aggregation is accomplished by heating at a temperature of below about the glass transition temperature of the polymer contained in the latex; a process wherein the coalescence is accomplished by heating at a temperature of above about the glass transition temperature of the polymer contained in the latex; a process wherein the aggregation temperature is from about 40° C. to about 62° C. and preferably is from about 45° C. to about 58° C.; a process wherein the coalescence temperature is from about 75° C. to about 95° C., and preferably about 85° C. to about 90° C.; a process wherein there is added to the aggregate mixture prior to coalescence a base component; a process wherein the base is an alkali metal hydroxide; a process wherein the hydroxide is sodium hydroxide; a process wherein the pH of the mixture resulting after aggregation is increased from about 2.0 to about 2.6 to about 7 to about 8, during the coalescence, and wherein the base functions primarily as a stabilizer for the aggregates during the coalescence; a process wherein the amount of base selected is from about 8 to about 25 weight percent and preferably is about 10 to about 20 weight percent; a process wherein the amount of metal hydroxide selected is from about 11 to about 14 weight percent; a process wherein the acid is selected from nitric, sulfuric, hydrochloric, acetic, citric and the like, wherein the preferred acid is nitric or citric acid; a process wherein the latex emulsion contains resin and a surfactant, and wherein the surfactant is of the Formulas (I) or (II), or optionally mixtures thereof.

(I)

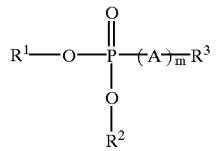

(II)

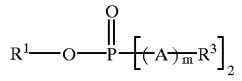

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; a process wherein $R^1$ is a hydrophobic moiety of alkyl or aryl; and wherein m is a number of from about 5 to about 60, or from about 10 to about 50, and there is accomplished a heating below about or equal to about the resin latex glass transition temperature to form aggregates followed by heating above about or equal to about the resin glass transition temperature to coalesce the aggregates; a process wherein the temperature at which the aggregation is accomplished controls the size of the aggregates, and wherein the final toner size is from about 2 to about 10 microns in volume average diameter; a process wherein the aggregation temperature is from about 45° C. to about 55° C., and wherein the coalescence or fusion temperature is from about 85° C. to about 95° C.; a process wherein the colorant is a pigment, and wherein the pigment is in the form of dispersion and contains an ionic surfactant and optionally a nonionic surfactant; a process wherein the surfactant utilized in the colorant dispersion is an anionic surfactant, and the ionic surfactant present in the latex mixture is also an anionic surfactant; a process wherein the aggregation is accomplished at a temperature of about 15° C. to about 1° C. below the Tg of the latex resin for a duration of from about 0.5 hour to about 3 hours, and wherein the coalescence or fusion of the components of aggregates for the formation of integral toner particles comprised of colorant and resin is accomplished at a temperature of from about 85° C. to about 95° C. for a duration of from about 1 hour to about 5 hours; a process wherein the latex contains submicron polymer or resin particles, containing a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitile-acrylic acid); a process wherein the latex contains a resin selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein the colorant is carbon black, cyan, yellow, magenta, or mixtures thereof; the toner isolated is from about 2 to about 10 microns in volume average diameter, and the particle size distribution thereof is from about 1.15 to about 1.30, and wherein there is added to the surface of the formed toner metal salts, metal salts of fatty acids, silicas, metal oxides, or mixtures thereof, each in an amount of from about 0.1 to about 10 weight percent of the obtained toner; a process which comprises mixing a latex comprising submicron, for example from about 0.05 to about 1 micron, resin particles, an ionic surfactant and colorant; heating the resulting mixture below, or equal to about the glass transition temperature of the resin, followed by the optional addition of the latex of the same composition and properties or differing composition and differing molecular properties, to the formed aggregates, followed by the addition of a base to stabilize the formed toner aggregates, thereafter heating the resulting aggregates above, or about equal to the glass transition temperature of the resin; followed by the addition of an acid after a period of about 0.5 to about 1 hour at the coalescence temperature to accelerate the coalescence process and thereafter retaining the temperature for an additional about 1 to about 4 hours, resulting in colored toner particles with very smooth surfaces and isolating, washing and drying the toner, a process wherein no change in particle size is observed with changes in the pH of the mixture during the coalescence; a process wherein the latex is prepared by a batch and optionally a semi-continuous polymerization resulting in submicron resin particles suspended in an aqueous phase containing ionic surfactant, and optionally a nonionic surfactant which can be hydrolyzable under basic conditions or optionally a single surfactant having both properties of an ionic and nonionic surfactant; a process for the preparation of toner comprising mixing a colorant, a latex emulsion, a first coagulant of a polyaluminum sulfosilicate and a second optional coagulant of a cationic surfactant, followed by aggregation and coalescence, and wherein the aggregation is accomplished by heating at a temperature of below the glass transition temperature of submicron polymeric resin particles contained in the latex, followed by optional addition of a second latex, followed by the addition of a base to stabilize the aggregates, and wherein the coalescence is accomplished by heating at a temperature of above the glass transition temperature of polymer contained in the latex, followed by the addition of an acid to reduce the pH to accelerate the coalescence process and subsequently isolating the toner; a process wherein the coagulant is polyaluminum sulfosilicate, including the derivatives thereof such as sodium-aluminum silicate, phosphate stabilized polyaluminum sulfate, basic aluminum sulfate containing polynucleate aluminum hydroxide sulfate and the like, and the second coagulant is an alkonium benzalkonium chloride, dialkylbenzenealkyl ammonium chloride, alkylbenzyl methyl ammonium chloride or alkylbenzyl dimethyl ammonium bromide; a process for the preparation of toner comprising aggregating and coalescing a colorant, a latex, and polyaluminum sulfosilicate; a process wherein optionally the coagulant is a water soluble metal salt; a process wherein the metal salt is selected from a group of the chlorides, sulfates, nitrates, and acetates of aluminum, magnesium, zinc, and potassium; a process wherein the salt is aluminum chloride, zinc sulfate, magnesium sulfate, magnesium chloride, potassium-aluminum sulfate, or zinc acetate; a process for the preparation of toner comprising mixing a colorant, a latex emulsion, and optionally adding a wax dispersion, a first coagulant of a polyaluminum sulfosilicate and a second optional coagulant of a water soluble salt selected in similar amounts as the polyaluminum sulfosilicate followed by aggregation and coalescence, and wherein the aggregation is accomplished by heating at a temperature of below the glass transition temperature of the submicron, less than or equal to about 1 micron, polymeric resin particles contained in the latex, followed by optional addition of a second latex, followed by the addition of a base to stabilize the aggregates, and wherein the coalescence is accomplished by heating at a temperature of above the glass transition temperature of polymer contained in the latex, followed by the addition of an acid to reduce the pH in order to accelerate the coalescence process and subsequently isolating the toner; toner processes comprising (i) preparing, or utilizing an aqueous colorant dispersion, which dispersion is comprised of a colorant and an ionic surfactant or optionally a nonionic surfactant and optionally a mixture of both surfactants in water or a single surfactant mixture containing both anionic and nonionic properties;

(ii) blending the colorant dispersion with a latex emulsion comprised of submicron resin particles, an ionic surfactant, a nonionic surfactant or a hydrolyzable nonionic surfactant as disclosed in U.S. Pat. No. 5,766,818, the disclosure of which is totally incorporated herein by reference, and thereafter adding a wax dispersion preferably comprised of submicron, for example from about 0.01 to about 1 micron, wax particles dispersed an ionic surfactant of similar charge polarity to that of the ionic surfactant in the latex emulsion;

(iii) adding to the blend of the latex, colorant particles, and wax particles, polyaluminum sulfosilicate dissolved in an acid, such as nitric acid to initiate flocculation of latex, colorant particles, and wax particles, (iv) heating the resulting mixture below the glass transition temperature (Tg) of the latex resin to form toner sized aggregates;

(v) optionally adding a known quantity of latex to the formed toner aggregates and stirring the reactor contents for about 30 minutes at a temperature below the resin Tg;

(vi) adjusting the pH of the toner aggregates from about 2 to about 8 with a base such as sodium hydroxide;

(vii) heating the resulting aggregate suspension of (vi) above about the Tg of the latex resin in the temperature;

(viii) retaining the mixture (vii) temperature in the range of from about 70 to about 95° C., for a period of 0.5 to 1 hour;

(ix) changing the pH of (viii) from 8.0 to about 4.5 with an dilute acid such as nitric acid to accelerate the coalescence;

(x) retaining the mixture (ix) at the coalescence temperature for additional 1 to 3 hours complete the fusion or coalescence of the toner aggregates, wherein the toner particle size and the particle size distribution is retained;

(xi) washing the toner slurry, preferably twice at a pH 11, followed by 2 water washes, isolating; and (xii) drying the toner obtained;

a toner processes comprising (i) preparing, or utilizing an aqueous colorant dispersion, which dispersion is comprised of a colorant and an ionic surfactant or optionally a nonionic surfactant and optionally a mixture of both surfactants in water;

(ii) blending the colorant dispersion with a latex emulsion comprised of submicron resin particles, an ionic surfactant optionally a nonionic surfactant or a hydrolyzable nonionic surfactant as disclosed in U.S. Pat. No. 5,766,818, the disclosure of which is totally incorporated herein by reference, and thereafter adding a wax dispersion preferably comprised of submicron wax particles dispersed an ionic surfactant of similar charge polarity to that of the ionic surfactant in the, colorant dispersion or in the latex emulsion;

(iii) adding to the blend of the latex, colorant, and wax particles, polyaluminum sulfosilicate dissolved in an acid, such as nitric acid and second coagulant of a metal soluble salt to initiate flocculation of latex and pigment particles, and wax particles;

(iv) heating the resulting mixture below the glass transition temperature (Tg) of the latex resin to form toner sized aggregates;

(v) optionally adding a known quantity of latex to the formed toner aggregates and stirring the reactor contents for about 30 minutes or other suitable time at a temperature below the resin Tg;

(vi) adjusting the pH of the toner aggregates from about 2 to about 8 with a base such as sodium hydroxide;

(vii) heating the resulting aggregate suspension of (vi) above about the Tg of the latex resin in the temperature;

(viii) retaining the mixture (vii) temperature in the range of from about 70° C. to about 95° C., for a period of about 0.5 to about 1 hour or other suitable time;

(ix) adjusting the pH of (viii) to about 4.5 with an dilute acid, such as nitric acid, to accelerate the coalescence process;

(x) retaining the mixture (ix) at the coalescence temperature for additional about 1 to about 3 hours complete the fusion or coalescence of the toner aggregates, wherein the toner particle size and the particle size distribution is retained;

(xi) washing the toner slurry, preferably twice at a pH 11, followed by 2 water washes, isolating and drying the toner obtained; and a toner process comprising (i) preparing, or utilizing an aqueous colorant dispersion, which dispersion is comprised of a colorant, an ionic surfactant, and a nonionic surfactant;

(ii) blending the colorant dispersion with a latex emulsion comprised of submicron, about 0.05 to about 0.99 micron for example, resin particles, an ionic surfactant optionally a nonionic surfactant or a hydrolyzable nonionic surfactant as disclosed in U.S. Pat. No. 5,766,818, the disclosure of which is totally incorporated herein by reference;

(iii) adding to the blend of the latex and colorant particles, polyaluminum sulfosilicate dissolved in an acid, such as nitric acid and an ionic surfactant, such as SANIZOL B™, of opposite charge polarity to that of the latex and colorant ionic surfactant to initiate flocculation of latex and pigment particles;

(iv) heating the resulting mixture below the glass transition temperature (Tg) of the latex resin to form toner sized aggregates;

(v) adding a known quantity, such as from about 35 to about 65 weight percent, of latex to the formed toner aggregates and stirring the reactor contents for about 30 minutes or other suitable time at a temperature below the resin Tg;

(vi) adjusting the pH of the toner aggregates from about 2 to about 8 with a base such as sodium hydroxide;

(vii) heating the resulting aggregate suspension of (vi) above about the Tg of the latex resin in the temperature;

(viii) retaining the mixture (vii) temperature in the range of from about 70° C. to about 95° C., for a period of 0.5 to 1 hour;

(ix) adjusting the pH of (viii) to about 4 to about 55 with an dilute acid such as nitric acid to accelerate the coalescence process;

(x) retaining the mixture (ix) at the coalescence temperature for additional 1 to 3 hours complete the fusion or coalescence of the toner aggregates, wherein the toner particle size and the particle size distribution is retained;

(xi) washing the toner slurry, preferably twice at a pH 11, followed by 2 water washes, isolating, and drying the toner obtained; processes for the preparation of toner particles resulting in excellent print quality, and document appearance, and wide processing latitude, wherein there is selected a latex preferably comprised of submicron resin particles which are in the size range of about 0.05 to about 0.5 micron and preferably in the size range of about 0.07 to about 0.35 micron, suspended in an aqueous water phase an ionic surfactant and a nonionic surfactant, which are preferably selected in an amount of about 0.5 to about 5 percent, and more preferably about 0.7 to about 2 percent by weight of solids, to which is added a colorant dispersion comprising submicron, for example less than, or equal to about 0.5 micron, colorant particles, anionic or a nonionic surfactant which is selected in the range amount of about 0.5 to about 10.0 percent and preferably about 0.6 to about 5 percent by weight of solids, which when blended together result in a mixture with a pH in the range of about 2 to about 2.6 to which a polyaluminum sulfosilicate (PASS) solution containing an acid like nitric acid is added slowly over, for example, a period of about 2 to about 5 minutes, and optionally followed by the addition of the cationic coagulant surfactant solution of SANIZOL B™ in water wherein the amount of PASS is preferably in the range of about 0.05 to about 0.8 percent by weight of the latex solids and colorant components, and more preferably in the range of about 0.06 to about 0.5 percent by weight; and the second optional coagulant, such as SANIZOL B™, is selected in the amount of about 0.05 to about 0.8 percent by weight of solids, and more preferably in the range of about 0.06 to about 0.5 percent by weight; further aggregating by stirring and heating from about 5 to 10 degrees below the resin Tg, resulting in toner aggregates of a size of about 3 to about 15 microns and preferably about 4 to about 8 microns with a narrow GSD in the range of, for example, about 1.14 to about 1.28 and preferably in the range of about 1.17 to about 1.25, and which improved GSD enables the clean transfer of the toner particles in xerographic systems thereby providing enhanced resolution of the fused images; followed by adjusting the pH of the mixture from about 2 to about 2.6 to a pH of about 6 to about 9 and preferably to about 7 to about 8.5, and more preferably to a pH of about 8 with the addition of a dilute base solution of 4 weight percent of sodium hydroxide to primarily stabilize the aggregates, further stirring and increasing the mixture temperature above the resin Tg, in the range of about 70° C. to about 95° C., and preferably in the range of about 85° C. to about 93° C. for a period of about 0.5 to about 1.5 hours, followed by changing the pH from about 8 to about 4.5 by the use of an acid, such as dilute nitric acid, and heating the mixture for an additional about 0.5 to about 4 hours and preferably from about 0.6 to about 3 hours, to fuse or coalesce the aggregates, and then washing and drying the toner; a toner process wherein a wax dispersion is added to the latex and colorant mixture, a toner process wherein a single coagulant of polyaluminum sulfosilicate and optionally a co-coagulant of a water soluble metal salts can be selected; a process wherein washing the toner particles containing the toner slurry at a pH of 11 is followed by filtration and reslurring of the filter cake comprised of toner particles in deionized water wherein this pH is adjusted to pH 11 with a base, such as sodium hydroxide, followed by another wash at pH 11 and two more washes with only water; and processes for the preparation of toner compositions which comprise blending an aqueous colorant dispersion preferably containing a pigment, such as carbon black, phthalocyanine, quinacridone or RHODAMINE B™ type, red, green, orange, brown, violet, yellow, fluorescent colorants and the like, with a latex emulsion derived from the emulsion polymerization of monomers selected, for example, from the group consisting of styrene, butadiene, acrylates, methacrylates, acrylonitrile, acrylic acid, methacrylic acid, itaconic or Beta Carboxy Ethyl Acrylate (BCEA) and the like, and which latex contains an ionic surfactant, such as sodium dodecylbenzene sulfonate, and optionally a nonionic surfactant, and which process is accomplished in the presence of a metal salt, or PASS and optionally a second coagulant cationic surfactant, heating the resulting flocculent mixture at a temperature below the resin Tg for an effective length of time of, for example, about 0.5 hour to about 3 hours to form toner sized aggregates; and optionally adding a known amount of delayed latex wherein the latex can be the same as the above initial latex or dissimilar in property, followed by adjusting the pH of the mixture from about 2 to about 8 with a dilute base solution of sodium hydroxide, and subsequently heating the aggregate suspension at a temperature at or below 95° C. for a period of 0.5 to 1 hour, adjusting the pH of the mixture from about 8 to about 4.5 with a dilute acid to provide toner particles, isolating the toner product by, for example, filtration, washing and drying in an oven, fluid bed dryer, freeze dryer, or spray dryer.

The particle size of the toner provided by the processes of the present invention in embodiments can be controlled, for example, by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter is obtained at an aggregation temperature of about 53° C.; the same latex will provide an aggregate size of about 5 microns at a temperature of about 48° C. under similar conditions.

Illustrative examples of specific latex resin, polymer or polymers selected for the process of the present invention and present in the latex include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-soprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitril-butyl acrylate-acrylic acid), and the like. The latex polymer, or resin is generally present in the toner compositions of the present invention in various suitable amounts, such as from about 75 weight percent to about 98, or from about 80 to about 95 weight percent of the toner or of the solids, and the latex size suitable for the processes of the present invention can be, for example, preferably from about 0.05 micron to about 0.5 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention is preferably prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Examples of functionalized waxes include, such as amines, amides, for example aqua SUPERSLIP 6550, SUPERSLIP 6530 available from Micro Powder Inc., fluorinated waxes, for example POLYFLUO 190, POLYFLUO 200, POLYFLUO 523XF, AQUA POLYFLUO 411, AQUA POLYSILK 19, POLYSILK 14 available from Micro Powder Inc., mixed fluorinated, amide waxes, for example MICROSPERSION 19 also available from Micro Powder Inc., imides, esters, quatemary amines, carboxylic acids or acrylic polymer emulsion, for example JONCRYL 74, 89, 130, 537, and 538, all available from S C Johnson Wax, chlorinated polypropylenes and polyethylenes commercially available from Allied Chemical and Petrolite Corporation and SC Johnson wax.

Various known colorants, such as pigments, selected for the processes of the present invention and present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northem Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOULIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL. Colored magnetites, such as mixtures of MAPICO BLACK™, and cyan components may also be selected as pigments with the process of the present invention, wherein the pigment is in the range of 3 to 15 weight percent of the toner. Dye examples include known suitable dyes, reference the Color Index, and a number of U.S. patents, such as food dyes, and the like.

Colorants include pigment, dye, mixtures of pigment and dyes, mixtures of pigments, mixtures of dyes, and the like.

Examples of initiators for the latex preparation include water soluble initiators, such as ammonium and potassium persulfates, in suitable amounts, such as from about 0.1 to about 8 percent and preferably in the range of from about 0.2 to about 5 percent (weight percent). Examples of organic soluble initiators include Vazo peroxides, such as VAZO 64, 2-methyl 2-2'-azobis propanenitrile, VAZO 88, 2-2'-azobis isobutyramide dehydrate in a suitable amount, such as in the range of from about 0.1 to about 8 percent. Examples of chain transfer agents include dodecane thiol, octane thiol, carbon tetrabromide and the like in various suitable amounts, such as in the range amount of from about 0.1 to about 10 percent and preferably in the range of from about 0.2 to about 5 percent by weight of monomer.

Surfactants for the preparation of latexes and colorant dispersions can be ionic or nonionic surfactants, in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. Examples of cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to about 4.

Examples of nonionic surfactants selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, can be selected and hydrolyzable or cleavable nonionic surfactants of the formulas illustrated herein, such as poly (ethylene glycol) methyl p-tert-octylphenyl phosphate, wherein the surfactant contains, for example, 40 ethylene glycol units, poly(ethylene glycol)-α-methyl ether-ω-methyl p-tert-octylphenyl phosphate (wherein the surfactant contains 17 ethylene glycol units) and the like.

Examples of the first coagulant are polyaluminum sulfosilicates, which, for example, can be represented by the formula $$Al_A(OH)_B(SO_4)_C(SiO_X)_D(H_2O)_E$$

wherein:

A is the number of Al segments and is preferably the number 1;

B is preferably from about 0.75 to about 2;

C is preferably from about 0.30 to about 1.12;

D is preferably from about 0.005 to about 0.1;

X is preferably equal to or greater than 2 but less than or equal to about 4 wherein preferably 3=B+2C+2D (X−2); and E is preferably larger than about 4, such as from about 5 to about 10, or more generally, wherein A, B, C, D, X and E represent the number of segments or atoms with respect to X, which represents the number of oxygen atoms.

Examples of the second surfactant coagulant are dialkyl benzenealkyl ammonium chloride, lauryl trimethyl ammonium chloride, alkylbenzyl methyl ammonium chloride, alkyl benzyl dimethyl ammonium bromide, wherein alkyl is, for example, preferably from about 5 to about 20 carbon atoms, with the amounts of each coagulant being from about 0.03 percent to about 1 percent by weight of toner aggregates and preferably from about 0.05 to about 0.5 percent by weight of toner aggregates.

Other examples of the second coagulant selected are water soluble metal salt selected from a group of the chlorides, sulfates, nitrates, and acetates of aluminum, magnesium, zinc, and potassium; wherein the salt is aluminum chloride, zinc sulfate, magnesium sulfate, magnesium chloride, potassium-aluminum sulfate, or zinc acetate and wherein water soluble metal salts refer to salts that are readily soluble in water.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa. The coated silicas of copending applications U.S. Ser. No. 09/132,623 and U.S. Pat. No. 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,990; 4,858,884; 4,584,253 and 4,563,408, the disclosures of which are totally incorporated herein by reference.

The following Examples and Comparative Examples are provided. In these Examples the P725 wax is a wax aqueous dispersion comprised of 30 weight percent of polyethylene wax in about 70 weight percent water, and about 0.7 weight percent of an anionic surfactant of sodium dodecyl benzene sultonate and 10 percent solids PASS refers to 90 percent water by weight and 10 percent by weight of PASS, total 100 percent of components of water and PASS.

Latex Preparation LATEX A ($M_w$ 30 k, $T_g$ 55 C.) (Anionic/Nonionic Surfactant)

A latex emulsion comprised of polymer particles generated from the emulsion polymerization of styrene, butyl acrylate and acrylic acid was prepared as follows. A mixture of 2,255 grams of styrene, 495 grams of butyl acrylate, 55 grams of acrylic acid, 27.5 grams of carbon tetrabromide and 96.25 grams of dodecanethiol, a chain transfer agent, was added to an aqueous solution prepared from 27.5 grams of an initiator of ammonium persulfate in 1,000 milliliters of water and 2,500 milliliters of an aqueous solution containing 62 grams of anionic surfactant, of sodium dodecyl benzene sulfonate (NEOGEN R™), and 33 grams of a polyethylene glycol, a onionic surfactant (ANTAROX™ CA897). The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 31,500, an $M_n$ of 6,900, as measured by Gel Permeation Chromatography, and a mid-point Tg of 54.9° C. measured by differential scanning calorimetry.

Latex Preparation: LATEX B ($M_w$ 30 k, $T_g$ 55 C. (Hyrolyzable Nonionic Surfactant)

A latex emulsion comprised of polymer particles generated from the emulsion polymerization of styrene, butyl acrylate and acrylic acid was prepared as follows. A mixture of 2,255 grams of styrene, 495 grams of butyl acrylate, 55 grams of acrylic acid, 27.5 grams of carbon tetrabromide and 96.25 grams of dodecanethiol was added to an oxygen free aqueous solution prepared from 27.5 grams of ammonium persulfate in 1,000 milliliters of water and 2,500 milliliters of an aqueous solution containing 62 grams of anionic surfactant, NEOGEN R™ which is sodium dodecylbenzene sulfonate (described as NEOGEN R™ throughout all Examples) and 33 grams of the nonionic surfactant poly(ethylene glycol)-α-methyl ether-ω-methyl p-tert-octylphenyl phosphate hydrolyzable nonionic surfactant. The resulting mixture was emulsified at room temperature, about 25° C., under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer of poly(styrene-co butyl acrylate-co-acrylic acid) possessed an $M_w$ of 29,300, and an $M_n$ of 7,212, as measured by Gel Permeation Chromatography, and a mid-point Tg of 55.6° C. as measured using Differential Scanning Calorimetry.

Latex C (12-30)

Latex Preparation—Semicontinuous

A latex emulsion comprised of polymer particles generated from the emulsion polymerization of styrene, butyl acrylate and beta carboxy ethyl acrylate (beta CEA) was prepared as follows. A surfactant solution consisting of 1.59 kilograms DOWFAX 2A1 (anionic emulsifier) and 430 kilograms of deionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80 degrees at a controlled tare to 80° C., and held there.

Separately, 6.8 kilograms of ammonium persulfate initiator was dissolved in 33.55 kilograms of deionized water.

Separately, the monomer emulsion was prepared in the following manner. 348 Kilograms of styrene, 104 kilograms of butyl acrylate and 14 kilograms of β-CEA, 6 kilograms of 1-dodecanethiol, 3 kilograms of ADOD, 8.05 kilograms of DOWFAX (anionic surfactant), and 216 kilograms of deionized water were mixed to form an emulsion. Five percent of the above emulsion was then slowly fed into the reactor containing the aqueous surfactant phase at 80° C. to form the "seeds" while being purged with nitrogen. The initiator solution was then slowly charged into the reactor and after 10 minutes the rest of the emulsion was continuously fed in using metering pumps.

Once all the monomer emulsion from above was charged into the main reactor, the temperature was held at 80° C. for an additional 2 hours to complete the reaction. Cooling was then applied and the reactor temperature was reduced to 35° C. The product comprised 40 percent of submicron, 0.5 micron, resin particle of styrene/butylacrylate/BCEA suspended in aqueous phase containing surfactant was collected into a holding tank. After drying the latex, the molecular properties were $M_w$=43,000, $M_n$=10.8 and the midpoint Tg was 57.5° C.

Latex D (12-39)

Latex Preparation—Semicontinuous

A latex emulsion comprised of polymer particles generated from the emulsion polymerization of styrene, butyl acrylate and beta carboxy ethyl acrylate (Beta CEA) was prepared as follows. A surfactant solution of 434 grams of DOWFAX 2A1 (anionic emulsifier) and 387 kilograms of deionized water was prepared by mIxing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80° C. at a controlled tare to 80° C., and held there.

Separately, 6.11 kilograms of ammonium persulfate initiator were dissolved in 30.2 kilograms of deionized water.

Separately, the monomer emulsion was prepared in the following manner. 315.7 Kilograms of styrene, 91.66 kilograms of butyl acrylate and 12.21 kilograms of β-CEA, 7.13 kilograms of 1-dodecanethiol, 1.42 kilograms of ADOD, 8.24 kilograms of DOWFAX (anionic surfactant), and 193 kilograms of deionized water were mixed to form an emulsion. Five percent of the above emulsion was then slowly fed into the reactor containing the aqueous surfactant phase at 80° C. to form the "seeds" while being purged with nitrogen. The initiator solution was then slowly charged into the reactor and after 10 minutes the remainder of the emulsion was continuously fed in using metering pumps.

Once all of the above monomer emulsion was charged into the main reactor, the temperature was maintained at 80° C. for an additional 2 hours to complete the reaction. The reactor contents were then cooled down. The resulting product comprised 40 percent of submicron, 0.5 micron, resin particles of styrene/butylacrylate/BCEA suspended in aqueous phase containing surfactant was collected into a holding tank. The molecular properties resulting from this latex were for the resin throughout $M_w$ of 39,000, $M_n$ 10.8 and a midpoint Tg of 55.8° C.

Latex E (12-19)

Latex Preparation—Semicontinuous

A latex emulsion comprised of polymer particles generated from the emulsion polymerization of styrene, butyl acrylate and Beta CEA was prepared as follows. A surfactant solution of 22.21 kilograms of ABEX 2010 (anionic/nonionic mixture emulsifier) and 411.3 kilograms of deionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80° C. at a controlled tare to 80° C., and held there.

Separately, 6.66 kilograms of ammonium persulfate initiator were dissolved in 33.7 kilograms of deionized water.

Separately, the monomer emulsion was prepared in the following manner. 344 Kilograms of styrene, 100 kilograms of butyl acrylate and 6.7 kilograms of acrylic acid, 4.12 kilograms of 1-dodecanethiol, 3.0 kilograms of ADOD, 22.2 kilograms of ABEX 2010 (anionicnonionic surfactant), and 190 kilograms of deionized water were mixed to form an emulsion. Five percent of the above emulsion was then slowly fed into the reactor containing the aqueous surfactant phase at 80° C. to form the "seeds" while being purged with nitrogen. The initiator solution was then slowly charged into the reactor and after 10 minutes the rest of the emulsion was continuously fed in using metering pumps.

After the monomer emulsion was charged into the main reactor, the temperature was held at 80° C. for an additional 2 hours to complete the reaction. The reactor contents were then cooled down to room temperature, about 25° C. to about 35° C. The product comprised 40 percent of submicron 0.6 resin particles of styrene/butylacrylate/BCEA suspended in aqueous phase containing surfactant was collected into a holding tank. The resin molecular properties resulting from this latex were $M_w$ of 62,000, $M_n$ 11.9 and a midpoint Tg of 58.0° C.

Toner Fabrication

EXAMPLE I

Aggregation of Cyan Toner (Latex A)

310 Grams of the above prepared latex emulsion A and 197 grams of an aqueous cyan pigment dispersion comprising 16 grams of cyan pigment 15.3 having a solids loading of 53.4 percent, and 48 grams of an aqueous wax dispersion of polyethylene P725 wax having a molecular weight ($M_w$) of 725 with a solids loading of 30 weight percent were simultaneously added to 600 milliliters of water with high shear stirring by means of a polytron. To this mixture were added 20 grams of the coagulant polyaluminum sulfosilicate (PASS) solution containing 3.2 grams of 10 percent solids and 16.8 grams of 0.2 molar nitric acid, over a period of 1 minute, followed by blending at speed of 5,000 rpm for a period of 2 minutes. The resulting mixture was transferred to a 2 liter reaction vessel and heated at a temperature of 50° C. for 125 minutes resulting in aggregates of a size of 5.2 microns and a GSD of 1.19. To the resulting toner aggregate were added 80 grams of latex A followed by stirring for an additional 30 minutes and the particle size was found to be 5.4 microns in diameter with a GSD of 1.20. The pH of the resulting mixture was then adjusted from 2 to 7.9 with an aqueous base solution of 4 percent sodium hydroxide and allowed to stir for an additional 15 minutes. Subsequently, the resulting mixture was heated to 85° C. and retained there for a period of 1 hour before changing the pH to 4.6 with 5 percent nitric acid. The temperature was held at 85° C. for an additional 1 hour, after which the temperature was further increased to 90° C. After 30 minutes at 90° C. the pH of the mixture was further reduced to 3.5 with nitric acid and the temperature of 90° C. was held for an additional 2.5 hours resulting in a particle size of 5.5 microns and a GSD of 1.20, after which the reactor contents were cooled down to room temperature, about 25° C. The resulting toner slurry pH was then further adjusted to 10 with a base solution of 5 percent of potassium hydroxide and stirred for 1 hour at a temperature of 65° C. followed by filtration and reslurrying of the wet cake resulting in 1 liter of water and stirred for 1 hour at 40° C. The above process was repeated followed by 1 wash at a pH of 4.0 (nitric acid) at 40° C. Two more water washings were then accomplished at a temperature of 40° C. The final toner product, after drying in a freeze dryer, was comprised of 86.3 percent of the polymer of latex A, 4.7 percent of pigment and 8 weight percent of wax with a toner particle size of 5.5 microns in volume average diameter and with a particle size distribution of 1.20 both as measured on a Coulter Counter. The toner morphology was shown to spherical in shape determined by scanning electron microscopy. The toner tribo charge as determined, for example, by the known Faraday Cage process was −11.7 and −1.2 millimeters displacements at 15 and 85 percent relative humidity, respectively, measured on a 35 micron carrier with a core of a ferrite with a 1.25 weight percent coating of polymethylmethacrylate and 50 percent of carbon black.

EXAMPLE II

Magenta Toner (Latex A)

A magenta toner was prepared by mixing 310 grams of the above prepared latex emulsion A and 200 grams of an aqueous magenta pigment dispersion containing 43 grams of magenta pigment PR 81.3 having a solids loading of 21 percent, and 48 grams of the wax dispersion P725 wax having a solids loading of 30 weight percent and simultaneously adding 600 milliliters of water with high shear at speeds of 3500 rpm by means of a polytron. To this mixture were added a 20.3 grams of polyaluminum sulfosilicate (PASS) solution containing 3.5 grams of 10 percent solids, 90 percent water, and 16.8 grams of 0.2 molar nitric acid, over a period of 1 minute, and blended at speed of 5,000 rpm for a period of 2 minutes. The resulting mixture was transferred to a 2 liter reaction vessel and heated at a temperature of 50° C. for 135 minutes resulting in aggregates of a size of 5.4 microns and a GSD of 1.19. To this toner aggregate were added 80 grams of latex A, followed by stirring for an additional 30 minutes and the particle size was found to be 5.5 with a GSD of 1.20. The pH of the resulting mixture was then adjusted from 2 to 8 with an aqueous base solution of 4 percent sodium hydroxide and allowed to stir for an additional 15 minutes. Subsequently, the resulting mixture was heated to 85° C. and retained there for a period of 1 hour before changing the pH to 4.6 with 5 percent nitric acid. The temperature was held at 85° C. for an additional 1 hour, after which the temperature was raised to 90° C. After 30 minutes at 90° C. the pH of the mixture was further reduced to 3.5 with nitric acid and the temperature was held at 90° C. for an additional 3.5 hours, before cooling down to room temperature, about 25° C. The resulting toner slurry pH was then further adjusted to 11 with a base solution of 6.8 percent of potassium hydroxide and stirred for 1 hour followed by filtration and reslurrying of the wet cake in 1 liter of water. The process of adjusting the pH was accomplished two more times followed by 2 water washings. This washing procedure is referred to as 2 pH, and 2 DIW. The final toner product, after drying in a freeze dryer was comprised of 87 percent of the polymer of latex A, 5 percent of pigment and 8 percent of wax with a toner particle size of 5.5 microns in volume average diameter and with a particle size distribution of 1.21 both as measured on a Coulter Counter. The morphology was shown to be of a spherical in shape by scanning electron microscopy. The toner tribo charge was −10.3 and −1.0 millimeter displacements at 15 and 85 percent relative humidity, respectively, measured on a 35 micron carrier with a core of a ferrite with a coating of polymethylmethacrylate and carbon black.

Comparative Example III

Aggregation of Cyan Toner (Latex A)

310 Grams of the above prepared latex emulsion A and 197 grams of an aqueous cyan pigment dispersion containing 16 grams of cyan pigment 15.3 having a solids loading of 53.4 percent, and 48 grams of the wax dispersion P725 wax having a solids loading of 30 weight percent were simultaneously added to 600 milliliters of water with high shear stirring by means of a polytron. To this mixture were added 20 grams of polyaluminum chloride (PAC) solution containing 3.2 grams of 10 percent solids and 16.8 grams of 0.2 molar nitric acid, over a period of 1 minute, and blended at speed of 5,000 rpm for a period of 2 minutes. The resulting mixture was transferred to a 2 liter reaction vessel and heated at a temperature of 50° C. for 130 minutes resulting in aggregates of a size of 5 microns and a GSD of 1.20. To this toner aggregate were added 80 grams of latex A, followed by stirring for an additional 30 minutes and the particle size was found to be 5.3 with a GSD of 1.20. The pH of the resulting mixture was then adjusted from 2 to 8 with an aqueous base solution of 4 percent sodium hydroxide and allowed to stir for an additional 15 minutes. Subsequently, the resulting mixture was heated to 85° C. and retained there for a period of 1 hour before changing the pH to 4.6 with 5 percent nitric acid. The temperature was held at 85° C. for an additional 1 hour, after which the temperature was raised to 90° C. After 30 minutes at 90° C. the pH of the mixture was further reduced to 3.5 with nitric acid and the temperature was held at 90° C. for an additional 2.5 hours resulting in a particle size of 5.4 microns and a GSD of 1.21, after which the reactor contents were cooled down to room temperature, about 25° C. The resulting toner slurry pH was then further adjusted to 10 with a base solution of 5 percent of potassium hydroxide and stirred for 1 hour at a temperature of 65° C. followed by filtration and reslurrying of the wet cake resulting in 1 liter of water and stirred for 1 hour at 40° C. A further wash at a pH of 4.0 (nitric acid) at 40° C. was then accomplished; followed by two more water washings at a temperature of 40° C. The final toner product, after drying in a freeze dryer, was comprised of 87.3 percent of the polymer of latex A and 4.7 percent of pigment, and the wax content was 8 weight percent, the toner particle size was 5.5 microns in volume average diameter with a particle size distribution of 1.20, both as measured on a Coulter Counter. The morphology was shown to be spherical in shape as determined by scanning electron microscopy. The toner tribo charge was −12.1 and −1.1 millimeter displacements at 15 and 85 percent relative humidity, respectively, measured on a 35 micron carrier with a core of a ferrite and a coating of polymethylmethacrylate and carbon black.

EXAMPLE IV

Aggregation of Cyan Toner (Latex B)

310 Grams of the above prepared latex emulsion B and 197 grams of an aqueous cyan pigment dispersion containing 16 grams of cyan pigment 15.3 having a solids loading of 53.4 percent (47.6 percent water), and 48 grams of wax dispersion of P725 wax having a solids loading of 30 weight percent, were simultaneously added to 600 milliliters of water with high shear stirring by means of a polytron. To this mixture were added 20 grams of a polyaluminum sulfosilicate (PASS) solution containing 3.3 grams of 10 percent solids and 16.8 grams of 0.2 molar nitric acid, over a period of 1 minute, and blended at speed of 5,000 rpm for a period of 2 minutes. The resulting mixture was transferred to a 2 liter reaction vessel and heated at a temperature of 50° C. for 125 minutes resulting in aggregates of a size of 5 microns and a GSD of 1.19. To this toner aggregate were added 100 grams of latex A and followed by stirring for an additional 30 minutes and the particle size was found to be 5.3 with a GSD of 1.20. The pH of the resulting mixture was then adjusted from 2 to 8 with an aqueous base solution of 4 percent sodium hydroxide and allowed to stir for an additional 15 minutes. Subsequently, the resulting mixture was heated to 85° C. and retained there for a period of 1 hour before changing the to 4.6 pH with 5 percent nitric acid. The temperature was held at 80° C. for an additional 1 hour, after which the temperature was raised to 90° C. After 30 minutes at 90° C. the pH of the mixture was further reduced to 3.5 with nitric acid and the temperature was held at 90° C. for an additional 3 hours resulting in a particle size of 5.5 microns and a GSD of 1.20, after which the reactor contents were cooled down to room temperature, about 25° C. The resulting toner slurry pH was then further adjusted to 10.0 with a base solution of 5 percent of potassium hydroxide and stirred for 1 hour at a temperature of 65° C. followed by filtration and reslurring of the wet cake resulting in 1 liter of water and stirring for 1 hour at 40° C. by washing at a pH of 4 (nitric acid) at 40° C.; and by two more water washings at a temperature of 40° C. The final toner product, after drying in a freeze dryer was comprised of 87.3 percent of the polymer of latex A, 4.7 percent of pigment and wax of 8 weight percent with a toner particle size of 5.5 microns in volume average diameter and with a particle size distribution of 1.20 both as measured on a Coulter. Counter. The morphology was shown to spherical in shape as determined by scanning electron microscopy. The toner tribo charge was −12.2 and −1.1 millimeter displacements at 15 and 85 percent relative humidity, respectively, measured on a 35 micron carrier with a core of a ferrite with a coating of polymethylmethacrylate and carbon black (1.25 weight percent coating of polymethylmethacrylate and 50 percent of carbon black).

EXAMPLE V

Magenta Toner (R 81.3)—Latex C 310.0 Grams of the above prepared latex emulsion C and 200 grams of an aqueous magenta pigment dispersion containing 34.4 grams of magenta pigment R 81.3 having a solids loading of 36.4 percent and the remainder being water throughout were simultaneously added to 600 milliliters of water with high shear stirring by means of a polytron. To this mixture were added 11.25 grams of polyaluminum sulfosilicate (PASS) solution containing 1.25 grams of 10 percent solids and 10 grams of 0.2 molar nitric acid, over a period of 1 minute, followed by the addition of 11.25 grams of a cationic surfactant solution containing 1.25 grams of the coagulant SANIZOL B™ (60 percent active ingredients) and 10 grams of deionized water and blended at speed of 5,000 rpm for a period of 2 minutes. The resulting mixture was transferred to a 2 liter reaction vessel and heated at a temperature of 50° C. for 125 minutes resulting in aggregates of a size of 5.2 microns and a GSD of 1.19. To the resulting toner aggregates were added 150 grams of latex C, followed by stirring for an additional 30 minutes, the particle size was found to be 5.2 with a GSD of 1.20. The pH of the resulting mixture was then adjusted from 2.0 to 7.9 with an aqueous base solution of 4 percent sodium hydroxide and allowed to stir for an additional 15 minutes. Subsequently, the resulting mixture was heated to 85° C. and retained there for a period of 1 hour before changing the to 4.6 with 5 percent nitric acid. The temperature was held at 85° C. for an additional 1 hour, after which the temperature was raised to 90° C. After 30 minutes at 90° C. the pH of the mixture was further reduced to 3.5 with nitric acid and the temperature was held at 90° C. for an additional 2.5 hours, before cooling down to room temperature, about 25° C. The resulting toner slurry pH was then further adjusted to 11.0 with a base solution of 6.8 percent of potassium hydroxide and stirred for 1 hour followed by filtration and reslurring of the wet cake resulting in 1 liter of water. The process of adjusting the pH was accomplished two more times followed by two water washings. This washing procedure was referred to as 2 pH and 2 DIW. The final toner product, after drying in a freeze dryer, was comprised of 93.2 percent of the polymer of latex A, and 6.8 percent of the above pigment with a toner particle size of 5.2 microns in volume average diameter and with a particle size distribution of 1.21 both as measured on a Coulter Counter. The morphology was shown to be of a spherical in shape by scanning electron microscopy. The toner tribo charge as determined by the Faraday Cage method throughout was −48.5 and −27.1 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent dispersed therein.

EXAMPLE VI

Cyan Toner (PB 15.3)—Latex C

A cyan toner was prepared in accordance with Example V comprising 200 grams of an aqueous cyan pigment dispersion containing 17.7 grams of a cyan pigment dispersion having a solids loading of 50.9 percent and the remainder being water. The amounts of coagulants added were in accordance with Example V. The blend comprising the latex and pigment particles was then heated to 50° C. for a period of 100 minutes resulting in a particle size of 6.5 microns with a GSD of 1.21. 150 Grams of latex C were then added and the mixture resulting allowed to stir for additional 30 minutes resulting in a particle size of 6.6 microns and a GSD of 1.20. The pH adjustment, followed by the heating to coalesce the aggregates was accomplished in accordance with Example V. After 3 hours at 90° C. at a pH of 4.5 the morphology of the toner particles as determined by an optical microscope was spherical. The particle size after washing and drying was 6.4 microns with a GSD of 1.21, and was comprised of 96.8 percent latex C and 4.2 percent pigment. The toner tribo charge as determined by the Faraday Cage method throughout was −37.2 and −14.0 microcoulombs per gram at 20 and 80 percent relative humidity, respectively, measured on a carrier with a core of a ferrite (copper, zinc containing ferrite), about 90 microns in diameter, with a coating of polymethylmethacrylate, 1.25 weight percent throughout, and carbon black, about 20 weight percent.

EXAMPLE VII

Red Toner (R 254)—Latex C

A red toner was prepared in accordance with Example V comprising 200 grams of an aqueous red pigment dispersion containing 20.9 grams of Red 254 pigment dispersion having a solids loading of 48 percent and 52 percent water. The amounts of each coagulant were as in Example V. The blend comprising the latex and pigment particles was then heated to 50° C. for a period of 110 minutes resulting in a particle size of 5.4 microns with a GSD of 1.19. 150 Grams of latex C were then added and the resulting mixture allowed to stir for an additional 30 minutes resulting in a toner particle size of 5.3 microns and a GSD of 1.20. The pH adjustment, followed by heating to coalesce the aggregates, was accomplished in accordance with Example V. After 1 hour at 90° C., the pH of the mixture was reduced to 4.5 with 5 percent nitric acid. After 2.5 hours at 90° C. at a pH of 4.5, the morphology of the toner particles as determined by an optical microscope was spherical. The particle size after washing and drying was 5.5 microns with a GSD of 1.20, and the resulting toner was comprised of 95 percent latex C and 5 percent pigment. The toner tribo charge as determined by the Faraday Cage method throughout was −34.1 and −13.0 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE VIII

Yellow Toner (Y 14)—Latex C

A yellow toner was prepared in accordance with Example V, comprising 200 grams of an aqueous yellow pigment dispersion containing 37 grams of Yellow 14 pigment dispersion having a solids loading of 44.9 percent and 55.1 percent water. The amounts of coagulants added were as in Example V. The blend comprising the latex and pigment particles was then heated to 50° C. for a period of 140 minutes resulting in a particle size of 5.0 microns with a GSD of 1.20. 150 Grams of latex C were then added and the resulting mixture allowed to stir for additional 30 minutes resulting in a particle size of 5.2 microns and a GSD of 1.19. The pH adjustment, followed by the heating to coalesce the aggregates, was carried out in accordance with Example V. After 1 hour at 90° C., the pH of the mixture was reduced to 4.5 with 5 percent nitric acid. After 3.5 hours at 90° C. at a pH of 4.5 the morphology of the toner particles as determined by an optical microscope was spherical. The particle size after washing and drying was 5.5 microns with a GSD of 1.21, and was comprised of 92 percent latex C and 8 percent of the above yellow pigment. The toner tribo charge as determined by the Faraday Cage method throughout was −35.2 and −16.0 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE IX

Black Toner (R 330)—Latex C

A black toner was prepared in accordance with Example V, comprising 200 grams of aqueous black pigment dispersion containing 21.1 grams of Black R 330 pigment dispersion having a solids loading of 47.8 percent and 52.2 percent water. The coagulants were added in accordance with Example V. The blend comprising the latex and pigment particles was then heated to 50° C. for a period of 140 minutes resulting in a particle size of 5.6 microns with a GSD of 1.23. 150 Grams of latex C were then added and the resulting mixture was allowed to stir for additional 30 minutes resulting in a particle size of 5.0 microns and a GSD of 1.20. The pH adjustment, followed by the heating to coalesce the aggregates, was accomplished in accordance with Example V. After 1 hour at 90° C., the pH of the mixture was reduced to 4.5 with 5 percent nitric acid. After 2.75 hours at 90° C. at a pH of 4.5, the morphology of the toner particles as determined by an optical microscope was spherical. The toner particle size after washing and drying was 5.8 microns with a GSD of 1.21, and comprised of 94.9 percent latex C (resin) and 5.1 percent pigment. The toner tribo charge as determined by the Faraday Cage method throughout was −43.8 and −18.0 microcoulombs per gram at 20 and 80 percent relative humidity, respectively, measured on a carrier with a core of a ferrite (copper, zinc containing ferrite obtained from Steward Chemicals), about 90microns in diameter, with a coating of polymethylmethacrylate and carbon black, about 20 weight percent.

EXAMPLE X

Red Toner (R 22/R 122)—Latex C

A red toner was prepared in accordance with Example V, comprising 200 grams of an aqueous red pigment dispersion containing 62.4 grams of R 22 red pigment dispersion having a solids loading of 43.4 percent and 2.7 grams of R 122 dispersion having a solids loading 40.2 percent, the remainder being water. Coagulants were added in accordance with Example V. The blend comprising the latex and pigment particles was then heated to 50° C. for a period of 120 minutes resulting in a particle size of 6 microns with a GSD of 1.21. 150 Grams of latex C were then added and allowed to stir for additional 30 minutes resulting in a particle size of 6.5 microns and a GSD of 1.20. The pH adjustment, followed by the heating to coalesce the aggregates, was carried out in accordance with Example V. After 1 hour at 90° C., the pH of the mixture was reduced to 4.5 with 5 percent nitric acid. After 2.75 hours at 90° C. at a pH of 4.5, the morphology of the toner particles as determined by an optical microscope was spherical. The particle size after washing and drying was 6.6 microns with a GSD of 1.21. The toner was comprised of 87 percent latex C resin and 13 percent pigment. The toner tribo charge as determined by the Faraday Cage method throughout was −22.6 and −13.6 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XI

Green Toner (G 36)—Latex C

A green toner was prepared in accordance with Example V, comprising 200 grams of an aqueous green pigment dispersion containing 80.8 grams of a Green 36 pigment dispersion having a solids loading of 35.4 percent and 64.6 percent water. Coagulants were added in accordance with Example V. The blend comprising the latex and pigment particles was then heated to 50° C. for a period of 110 minutes resulting in a particle size of 6.2 microns with a GSD of 1.20. 150 Grams of latex C were then added and the mixture was allowed to stir for additional 30 minutes resulting in a particle size of 6.4 microns and a GSD of 1.19. The pH adjustment, followed by the heating to coalesce the aggregates, was carried out in accordance with Example V. After 1 hour at 90° C., the pH of the mixture was reduced to 4.5 with 5 percent nitric acid. After 6 hours at 90° C. at a pH of 4.5 the morphology of the toner particles as determined by an optical microscope was spherical. The particle size after washing and drying was 6.4 microns with a GSD of 1.21. The toner product was comprised of 87 percent latex C resin and 13 percent pigment. The toner tribo charge as determined by the Faraday Cage method throughout was −24.7 and −12.0 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XII

Blue Toner (PB 15.3)—Latex C

A blue toner was prepared in accordance with Example V, comprising of 200 grams of aqueous blue pigment dispersion containing 45.5 grams of PB 15.3 pigment dispersion having a solids loading of 51 percent and 49 percent water. Coagulants were added in accordance with Example V. The blend comprising the latex and pigment particles are then heated to 50° C. for a period of 140 minutes resulting in a particle size of 5.9 microns with a GSD of 1.22. 150 Grams of latex C were then added and the resulting mixture was allowed to stir for additional 30 minutes resulting in a particle size of 6.0 microns and a GSD of 1.20. The pH adjustment, followed by heating to coalesce the aggregates, was carried out in accordance with Example V. After 1 hour at 90° C., the pH of the mixture was reduced to 4.5 with 5 percent nitric acid. After 3 hours at 90° C. at a pH of 4.5, the morphology of the toner particles as determined by an optical microscope was spherical. The particle size after washing and drying was 6 microns with a GSD of 1.20. The toner product was comprised of 89.2 percent of latex C resin and 10.8 percent pigment. The toner tribo charge as determined by the Faraday Cage method throughout was −30 and −12.5 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XIII

Blue Toner (PB 15.0)—Latex C

A blue toner was prepared in accordance with Example V, comprising 200 grams of an aqueous blue pigment dispersion containing 42.6 grams of PB 15.0 pigment dispersion having a solids loading of 54.4 percent and 55.6 percent water. Coagulants were added in accordance with Example V. The blend comprising the latex and pigment particles was then heated to 50° C. for a period of 150 minutes resulting in a particle size of 5.6 microns with a GSD of 1.21. 150 Grams of latex C were then added and the mixture resulting was allowed to stir for additional 30 minutes resulting in a particle size of 5.6 microns and a GSD of 1.20. The pH adjustment, followed by the heating to coalesce the aggregates, was carried out in accordance with Example V. After 1 hour at 90° C., the pH of the mixture was reduced to 4.5 with 5 percent nitric acid. After 4 hours at 90° C. at a pH of 4.5, the morphology of the toner particles as determined by an optical microscope was spherical. The particle size after washing and drying was 5.7 microns with a GSD of 1.20. The toner product was comprised of 89.2 percent of latex C resin and 10.8 percent pigment. The toner tribo charge as determined by the Faraday Cage method throughout was −30 and −12.5 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XIV

Red Toner (R 112)—Latex C

A red toner was prepared in accordance with Example V, comprising 200 grams of aqueous red pigment dispersion containing 24.4 grams of R 112 pigment dispersion having a solids loading of 45.1 percent and 54.9 percent water. Coagulants were added in accordance with Example V. The blend comprising of the latex and pigment particles was then heated to 49° C. for a period of 150 minute resulting in a particle size of 5 microns with a GSD of 1.24. 150 Grams of latex C were then added and allowed to stir for additional 30 minutes resulting in a particle size of 5.3 microns and a GSD of 1.24. The pH adjustment, followed by the heating to coalesce the aggregates, was carried out in accordance with Example V. After 1 hour at 90° C., the pH of the mixture was reduced to 4.5 with 5 percent nitric acid. After 2.5 hours at 90° C. at a pH of 4.5, the morphology of the toner particles as determined by an optical microscope was spherical. The particle size after washing and drying was 5.2 microns with a GSD of 1.25. The toner product was comprised of 94.9 percent latex C resin and 5.1 percent pigment. The toner tribo charge as determined by the Faraday Cage method throughout was −30 and −12.5 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XV

Cyan Toner (PB 15.3)—Latex D

A cyan toner was prepared in accordance with Example I using latex D, and 200 grams of aqueous cyan pigment dispersion containing 17.7 grams of PB 15.3 pigment dispersion having a solids loading of 51 percent and 54.9 percent water. Wax was also added in accordance with the Example I. The amounts of coagulants were added in accordance with Example I. The blend comprising the latex and pigment particles was then heated to 50° C. for a period of 160 minutes resulting in a particle size of 5.4 microns with a GSD of 1.20. 150 Grams of latex D were then added and allowed to stir for additional 30 minutes resulting in a particle size of 5.3 microns with a GSD of 1.18. The pH adjustment, followed by the heating to coalesce the aggregates, was carried out in accordance with Example I. After 1 hour at 90° C., the pH of the mixture was reduced in accordance with Example I. After 4.5 hours at 90° C. at a pH of 3.5, the morphology of the toner particles as determined by an optical microscope was spherical. The particle size after washing and drying was 5.4 microns with a GSD of 1.19, and comprised of 87.8 percent latex D resin, 4.2 percent pigment and 8 percent wax. The toner tribo charge as determined by the Faraday Cage method throughout was −34 and −13 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XVI

Cyan Toner (PB 15.3)—Latex D

A cyan toner was prepared in accordance with Example V using latex D and 200 grams of aqueous cyan pigment dispersion containing 17.7 grams of Pb: 15.3 pigment dispersion having a solids loading of 51 percent and the rest being water. The amounts of coagulants were added in accordance with Example V. The blend comprising the latex and pigment particles was then heated to 5° C. for a period of 110 minutes resulting in a particle size of 5.5 microns with a GSD of 1.20. 150 Grams of latex D were then added and allowed to stir for additional 30 minutes resulting in a particle size of 5.6 microns with a GSD of 1.19. The pH adjustment, followed by the heating to coalesce the aggregates, was carried out in accordance with Example V. After 1 hour at 90° C., the pH of the mixture was reduced to 4.5 with 5 percent nitric acid. After 3.5 hours at 90° C. at a pH of 4.5, the morphology of the toner particles as determined by an optical microscope was spherical. The particle size after washing and drying was 5.5 microns with a GSD of 1.21, and comprised of 96.8 percent latex D resin and 4.2 percent pigment. The toner tribo charge as determined by the Faraday Cage method throughout was −33 and −13.9 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XVII

Cyan Toner (PB 15.3)—Latex E

A cyan toner was prepared in accordance with Example I using latex E comprising 200 grams of aqueous cyan pigment dispersion containing 17.7 grams of PB 15.3 pigment dispersion having a solids loading of 51 percent and 54.9 percent water. Wax was also added in accordance with the Example I. The amounts of coagulants were added in accordance with Example I. The blend comprising the latex and pigment particles was then heated to 51° C. for a period of 140 minutes resulting in a particle size of 5.9 microns with a GSD of 1.20. 150 Grams of latex E were then added and allowed to stir for an additional 30 minutes resulting in a particle size of 6.1 microns with a GSD of 1.20. The pH adjustment, followed by the heating to coalesce the aggregates, was carried out in accordance with Example I. After 1 hour at 90° C., the pH of the mixture was reduced in accordance with Example I. After 4.0 hours at 90° C. at a pH of 3.5, the morphology of the toner particle as determined by an optical microscope was spherical. The particle size after washing and drying was 6.1 microns with a GSD of 1.19, and comprised of 87.8 percent latex E, 8 percent wax and 4.2 percent pigment. The toner tribo charge as determined by the Faraday Cage method throughout was −32 and −11.8 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XVIII

Yellow Toner (Y 180)—Latex E

A yellow toner was prepared in accordance with Example I using latex E comprising 200 grams of aqueous yellow pigment dispersion containing 188 grams of Y 180 pigment dispersion having a solids loading of 12 percent and 54.9 percent water. Wax was also added in accordance with the Example I. The amounts of coagulants were added in accordance with Example I. The blend comprising the latex and pigment particles was then heated to 51° C. for a period of 170 minutes resulting in a particle size of 5.8 microns with a GSD of 1.20. 150 Grams of latex E were then added and allowed to stir for an additional 30 minutes resulting in a particle size of 6.0 microns with a GSD of 1.21. The pH adjustment, followed by the heating to coalesce the aggregates, was carried out in accordance with Example I. After 1 hour at 90° C., the pH of the mixture was reduced in accordance with Example I. After 4.0 hours at 90° C. at a pH of 3.5, the morphology of the toner particles as determined by an optical microscope was spherical. The particle size after washing and drying was 6.1 microns with a GSD of 1.19, and comprised of 84 percent latex C resin, 8 percent wax and 8 percent pigment. The toner tribo charge as determined by the Faraday Cage method throughout was −27 and −10 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

EXAMPLE XIX

Cyan Toner (PB 15.3)—Latex E

A cyan toner was prepared in accordance with Example V using latex E and 200 grams of aqueous cyan pigment dispersion containing 17.7 grams of PB 15.3 pigment dispersion having a solids loading of 51 percent and 54.9 percent water. The amounts of coagulants were added in accordance with Example V. The blend comprising the latex and pigment particles was then heated to 50° C. for a period of 130 minutes resulting in a particle size of 6.5 microns with a GSD of 1.20. 150 Grams of latex E were then added and allowed to stir for additional 30 minutes resulting in a particle size of 6.3 microns and a GSD of 1.19. The pH adjustment, followed by the heating to coalesce the aggregates, was carried out in accordance with Example V. After 1 hour at 90° C., the pH of the mixture was reduced to 4.5 with 5 percent nitric acid. After 3 hours at 90° C. at a pH of 4.5, the morphology of the toner particles as determined by an optical microscope was spherical. The particle size after washing and drying was 5.5 microns with a GSD of 1.21, and comprsed of 96.8 percent latex E resin and 4.2 percent pigment. The toner tribo charge as determined by the Faraday Cage method throughout was −35 and −16 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner comprising mixing a colorant, a latex comprising a latex resin, optionally a wax and a polyaluminum sulfosilicate coagulant; heating in the presence of said polyaluminum sulfosilicate below about or equal to about the glass transition temperature of the latex resin to form toner aggregates; followed by the addition of a base to stabilize the toner aggregates; thereafter heating the resultant aggregates above about, or about equal to the glass transition temperature of the latex; and isolating, washing and drying the resultant toner.

2. A process in accordance with claim 1 wherein (i) said colorant is a colorant dispersion comprised of a colorant, water, an ionic surfactant, or a nonionic surfactant, and wherein said latex is an emulsion comprised of a nonionic surfactant and an ionic surfactant, water and resin;

(ii) wherein said colorant dispersion is blended with said latex emulsion, and thereafter adding a wax dispersion comprised of submicron wax particles in the size range of from about 0.1 to about 0.5 micron in diameter by volume, which wax is dispersed in an ionic surfactant of the same charge polarity of said latex ionic surfactant present;

(iii) adding to the resulting blend containing the latex, colorant, and said polyaluminum sulfosilicate coagulant to thereby initiate flocculation or aggregation of the resin latex and colorant particles;

(iv) heating the resulting mixture below about, or about equal to the glass transition temperature (Tg) of the latex resin to form toner sized aggregates;

(v) optionally adding a latex comprised of resin particles suspended in an aqueous phase to the formed toner aggregates;

(vi) adding to the mixture resulting a base to thereby arrive at a pH of from about 5 to about 8 for the resulting toner aggregate mixture;

(vii) effecting coalescence by heating the resulting aggregate suspension of (vi) above about, or about equal to the Tg of the latex resin;

(viii) optionally retaining the mixture (vii) temperature in the range of from about 70° C. to about 95° C. to assist in permitting the fusion or coalescence of the toner aggregates;

(ix) optionally separating and washing the resulting toner slurry; and (x) optionally isolating the toner.

3. A process in accordance with claim 2 wherein (viii), (ix) and (x) are accomplished.

4. A process in accordance with claim 2 wherein (v), (viii), (ix) and (x) are accomplished.

5. A process in accordance with claim 2 wherein said base is selected from the group consisting of sodium hydroxide, potassium hydroxide, and ammonium hydroxide.

6. A process in accordance with claim 2 wherein there is added to the formed toner aggregates a second latex comprised of submicron resin particles suspended in an aqueous phase containing an ionic surfactant, and wherein said second latex is selected in an amount of about 10 to about 40 percent by weight of the initial latex to form a shell on the toner aggregates.

7. A process in accordance with claim 6 wherein the added latex contains the same resin as the initial latex.

8. A process in accordance with claim 6, wherein the added latex contains a dissimilar resin than that of the initial latex.

9. A process in accordance with claim 2 wherein the aggregation (iv) is accomplished by heating at a temperature below about glass transition temperature of the resin contained in the latex.

10. A process in accordance with claim 9 wherein said aggregation temperature is from about 40° C. to about 60° C.

11. A process in accordance with claim 2 wherein the coalescence (vii) is accomplished by heating at a temperature of about above the glass transition temperature of the resin contained in the latex.

12. A process in accordance with claim 11 wherein said coalescence temperature is from about 75° C. to about 97° C.

13. A process in accordance with claim 2 wherein said nonionic surfactant is a cleavable hydrolyzable surfactant.

14. A process in accordance with claim 13 wherein said surfactant is (I)

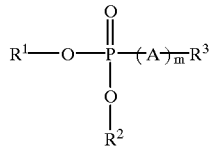

(II)

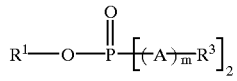

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments.

15. A process in accordance with claim 13 wherein the hydrolyzable surfactant is a cleavable surfactant selected from the group consisting of poly(ethylene glycol) methyl p-tert-octylphenyl phosphate, poly(ethylene glycol)-α-methyl ether-ω-methyl p-tert-octylphenyl phosphate, poly (ethylene glycol) methyl decylphenyl phosphate, poly (ethylene glycol)-α-methyl ether-ω-methyl dodecylphenyl phosphate, poly(ethyleneglycol) methyl dodecylphenyl phosphate, bis[poly(ethylene glycol)-α-methyl ether]-ω-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly (ethylene glycol) phenyl p-tert-octylphenyl phosphate, poly (ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly (ethylene oxide-co-propylene oxide) methyl p-tert-octylphenyl phosphate, wherein the polymer chain contains from about 5 to about 50 repeating units or segments.

16. A process in accordance with claim 2 wherein said base is an alkali metal hydroxide.

17. A process in accordance with claim 16 wherein said hydroxide is sodium hydroxide.

18. A process in accordance with claim 2 wherein the pH of the mixture resulting in (vi) is increased from about 2 to about 2.6 to about 5 to about 8, and wherein said base functions primarily as a stabilizer for the aggregates during said coalescence, and no or minimal particle size or GSD increase results.

19. A process in accordance with claim 2 wherein the temperature at which the aggregation is accomplished controls the size of the aggregates, and wherein the final toner size is from about 2 to about 15 microns in volume average diameter.

20. A process in accordance with claim 2 wherein the aggregation (iv) temperature is from about 45° C. to about 55° C., and wherein the coalescence or fusion temperature of (vii) and (viii) is from about 85° C. to about 95° C.

21. A process in accordance with claim 2 wherein the colorant is carbon black, cyan, yellow, magenta, or mixtures thereof; the toner isolated is from about 2 to about 15 microns in volume average diameter, and the particle size distribution thereof is from about 1.15 to about 1.30; and wherein there is added to the surface of the formed toner metal salts, metal salts of fatty acids, silicas, metal oxides, or mixtures thereof, each in an amount of from about 0.1 to about 10 weight percent of the obtained toner.

22. A process in accordance with claim 2 wherein there is further added a second coagulant of an alkonium benzalkonium chloride, dialkylbenzenealkyl ammonium chloride, alkylbenzyl methyl ammonium chloride or alkylbenzyl dimethyl ammonium bromide in an amount of from about 0.05 to about 0.5 weight percent by weight.

23. A process in accordance with claim 2 wherein (v) is accomplished.

24. A process in accordance with claim 3 wherein there is selected a second coagulant of a cationic surfactant.

25. A process in accordance with claim 2 wherein there is selected a second coagulant of a cationic surfactant.

26. A process in accordance with claim 25 wherein the cationic surfactant is a benzalkonium chloride.

27. A process in accordance with claim 1 wherein said polyaluminum sulfosilicate is selected in an amount of from about 0.05 to about 0.5 percent by weight of resin and colorant, and wherein said resin, coagulant, and colorant amount totals about 100 percent.

28. A process in accordance with claim 1 wherein the colorant is a pigment, and wherein said pigment is in the form of dispersion, and which dispersion contains an ionic surfactant, and wherein said polyaluminum sulfosilicate functions as a coagulant and enables aggregation of said latex and said colorant.

29. A process in accordance with claim 1 wherein the latex contains a resin selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

30. A process in accordance with claim 1 wherein prior to isolating said heating is retained at a temperature of from about 70° C. to about 95° C. until fusion or coalescence of said aggregates is accomplished.

31. A process in accordance with claim 1 wherein said polyaluminum sulfosilicate possesses a weight average molecular weight of from about 5,000 to about 100,000.

32. A process in accordance with claim 1 wherein said polyaluminum sulfosilicate is of the formula $$Al_A(OH)_B(SO_4)_C(SiO_x)_D(H_2O)_E$$

where A, B, C, D and E represent the number of segments, and X represents the number of oxygens.

33. A process in accordance with claim 32 wherein A is 1, B is from about 0.75 to about 2, C is from about 0.30 to about 1.12, D is from about 0.005 to about 0.1, and X is from about 2 to about 4.

34. A process for the preparation of toner comprising mixing a colorant, a latex comprising a latex resin, a wax and a polyaluminum sulfosilicate coagulant, and which coagulant assists in permitting aggregation and coalescence of said colorant, said latex, and said wax; heating in the presence of said polyaluminum sulfosilicate below about or equal to about the glass transition temperature of the latex resin to form toner aggregates; followed by the addition of a base to stabilize the toner aggregates; thereafter heating the resulting aggregates above about, or about equal to the glass transition temperature of the latex resin; and isolating, washing and drying the resultant toner.

35. A process in accordance with claim 34 wherein said coagulant is added during or prior to aggregation of the resin and colorant, and which coagulant enables or initiates said aggregation.

36. A process in accordance with claim 34 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid).

37. A process in accordance with claim 34 wherein said polyaluminum sulfosilicate is selected in an amount of from about 0.05 to about 0.35 weight percent based on the weight of toner solids of resin, colorant, and sulfosilicate.

38. A process in accordance with claim 34 wherein said polyaluminum sulfosilicate is of the formula $$Al_A(OH)_B(SO_4)_C(SiO_x)_D(H_2O)_E$$

where A, B, C, D, and E represent the number of segments, and X represents the number of oxygens.

39. A process for the preparation of toner comprising aggregation and coalescing a colorant dispersion, a latex containing a polymer, a wax, and a polyaluminum sulfosilicate.

40. A process in accordance with claim 39 wherein said polyaluminum sulfosilicate is selected in an amount of from about 0.05 to about 0.5 weight percent based on the weight of resin, colorant, wax, and said sulfosilicate.

41. A process for the preparation of toner comprising the mixing of a colorant dispersion, a latex emulsion, a wax dispersion and a polyaluminum sulfosilicate, and wherein said mixture is aggregated by heating below the latex resin glass transition temperature, and fusing said resulting aggregates by heating above the latex resin glass transition temperature, wherein said aggregate mixture is at a pH of from about 5 to about 8, and wherein said latex is comprised of resin, nonionic surfactant, ionic surfatant, and water.

42. A process in accordance with claim 41 wherein said sulfosilicate functions as a coagulant and enables or assists in enablement of said aggregation.

* * * * *